US008500458B2

(12) United States Patent
Chang et al.

(10) Patent No.: US 8,500,458 B2
(45) Date of Patent: Aug. 6, 2013

(54) SOCKET CONNECTOR WITH CONTACT HAVING DUAL-CONTACTING-PORTION CREATED BY SPLITTING AND TWISTING

(75) Inventors: Yen-Chih Chang, New Taipei (TW); Ke-Hao Chen, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 145 days.

(21) Appl. No.: 13/096,999

(22) Filed: Apr. 28, 2011

(65) Prior Publication Data

US 2011/0269330 A1 Nov. 3, 2011

(51) Int. Cl.
*H01R 12/00* (2006.01)

(52) U.S. Cl.
USPC ..... 439/66; 439/862

(58) Field of Classification Search
USPC ..... 439/66, 862, 71, 331, 733.1
See application file for complete search history.

(56) References Cited

U.S. PATENT DOCUMENTS

| | | | | |
|---|---|---|---|---|
| 4,553,192 | A | 11/1985 | Babuka et al. | |
| 5,139,427 | A | 8/1992 | Boyd et al. | |
| 6,695,624 | B1 * | 2/2004 | Szu | 439/66 |
| 6,976,888 | B2 | 12/2005 | Shirai et al. | |
| 7,473,103 | B2 * | 1/2009 | Liao et al. | 439/66 |
| 7,559,811 | B1 * | 7/2009 | Polnyi | 439/862 |
| 7,563,105 | B2 * | 7/2009 | Liu et al. | 439/66 |
| 7,625,217 | B1 * | 12/2009 | Liao | 439/66 |
| 8,202,100 | B2 * | 6/2012 | Luo | 439/66 |

* cited by examiner

*Primary Examiner* — Hien Vu
(74) *Attorney, Agent, or Firm* — Wei Te Chung; Ming Chieh Chang

(57) ABSTRACT

A socket connector includes a socket body having an array of passageways; and an array of contacts received in passageways respectively. Each contact includes a retaining section received within the passageway, an engaging section extending from the retaining section. The engaging section has an oblique resilient arm extending out of the passageway. The resilient arm is split and altered so that a pair of split surfaces are formed as contacting surfaces which are substantially exposed upwardly.

7 Claims, 8 Drawing Sheets

SOCKET CONNECTOR WITH CONTACT HAVING DUAL-CONTACTING-PORTION CREATED BY SPLITTING AND TWISTING

BACKGROUND OF THE INVENTION

1. Field of the Invention

The present invention relates to a socket connector, and more particularly to a socket connector equipped with a plurality of contacts each with split and twisted dual-contact portions.

2. Description of Related Art

An IC package is generally coupled with a system via a socket connector mounted on a mother board. One type of the IC package which is referred to as LGA (Land Grid Array) package has an array of conductive lands at the bottom thereof In correspondence, the socket connector has an array of LGA contacts that engage the lands respectively.

The LGA contact is well known in the art and can be referred to from U.S. Pat. No. 6,976,888, U.S. Pat. No. 4,553,192, U.S. Pat. No. 5,139,427, and so on. A conventional LGA contact is generally configured with an upper contacting portion for engaging with the LGA package, a lower contacting portion for engaging with a printed circuit board on which the socket is mounted. The upper contacting portion has a smooth or planar contacting surface in contact with the land of the LGA package. To ensure a low and reliable LLCR (low level contact resistance), abundant contacting force between the contact and the package is needed, which consequently requests a long resilient contacting arm of the contact. However, long contacting arm is not good for the minimization of the socket connector.

In view of the above, an improved connector is desired to overcome the above-mentioned problem.

SUMMARY OF THE INVENTION

Accordingly, an object of the present invention is to provide a low profile socket connector.

According to one aspect of the present invention, there is provided a socket connector which includes a socket body having an array of passageways; and an array of contacts received in passageways respectively. Each contact includes a retaining section received within the passageway, an engaging section extending from the retaining section. The engaging section has an oblique resilient arm extending out of the passageway. The resilient arm is split and altered so that a pair of split surfaces are formed as contacting surfaces which are substantially exposed upwardly.

Other objects, advantages and novel features of the invention will become more apparent from the following detailed description when taken in conjunction with the accompanying drawings, in which:

DETAILED DESCRIPTION OF THE INVENTION

Reference will now be made to the drawings to describe the present invention in detail.

Figure 1:
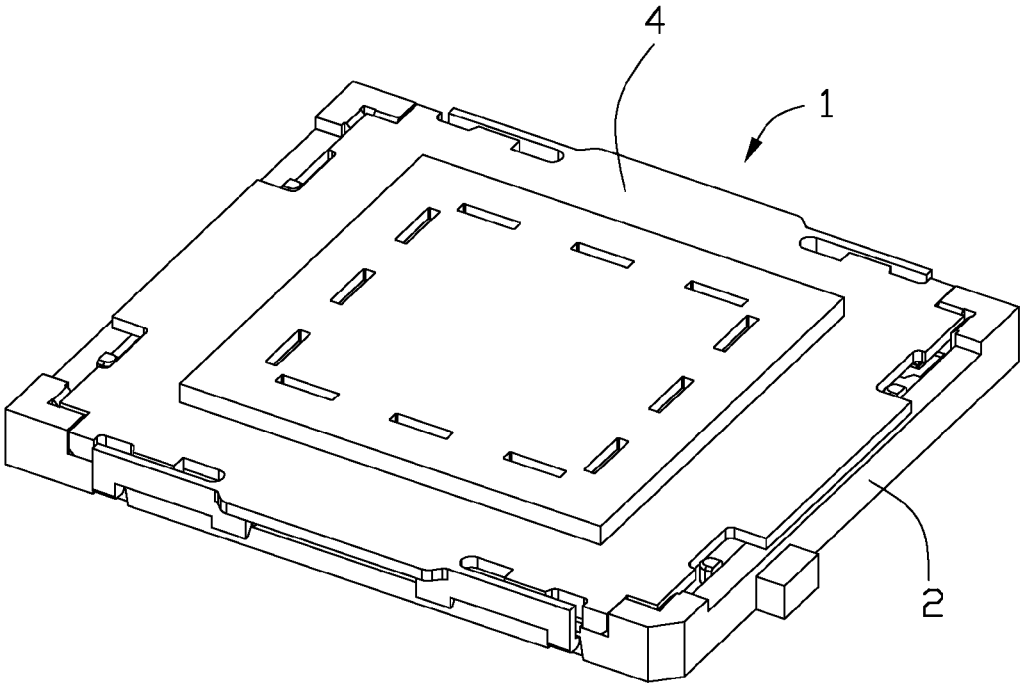
FIG. 1 is an assembled, perspective view of a socket connector in accordance with a preferred embodiment of the present invention.
Figure 2:
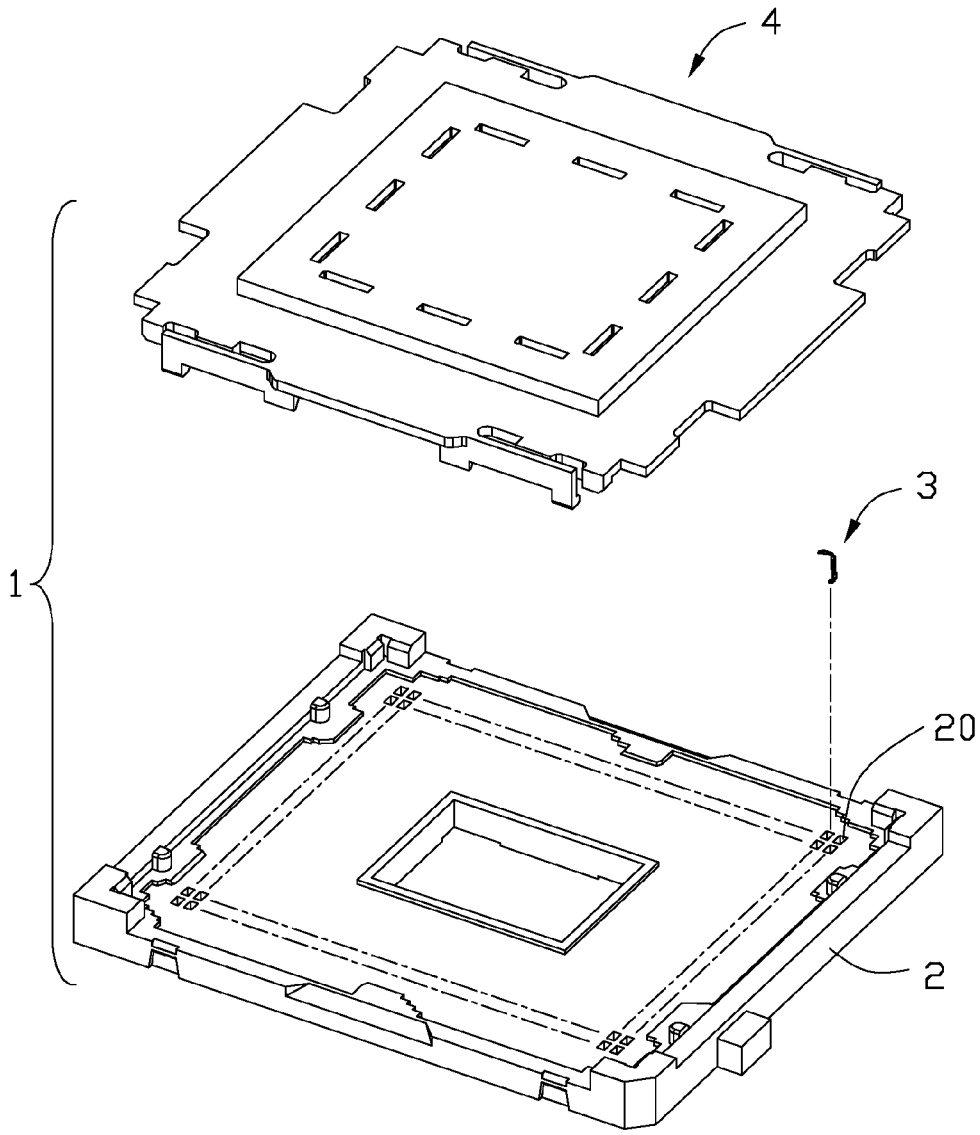
FIG. 2 is an exploded, perspective view of the socket connector as shown in FIG. 1.
Figure 3:
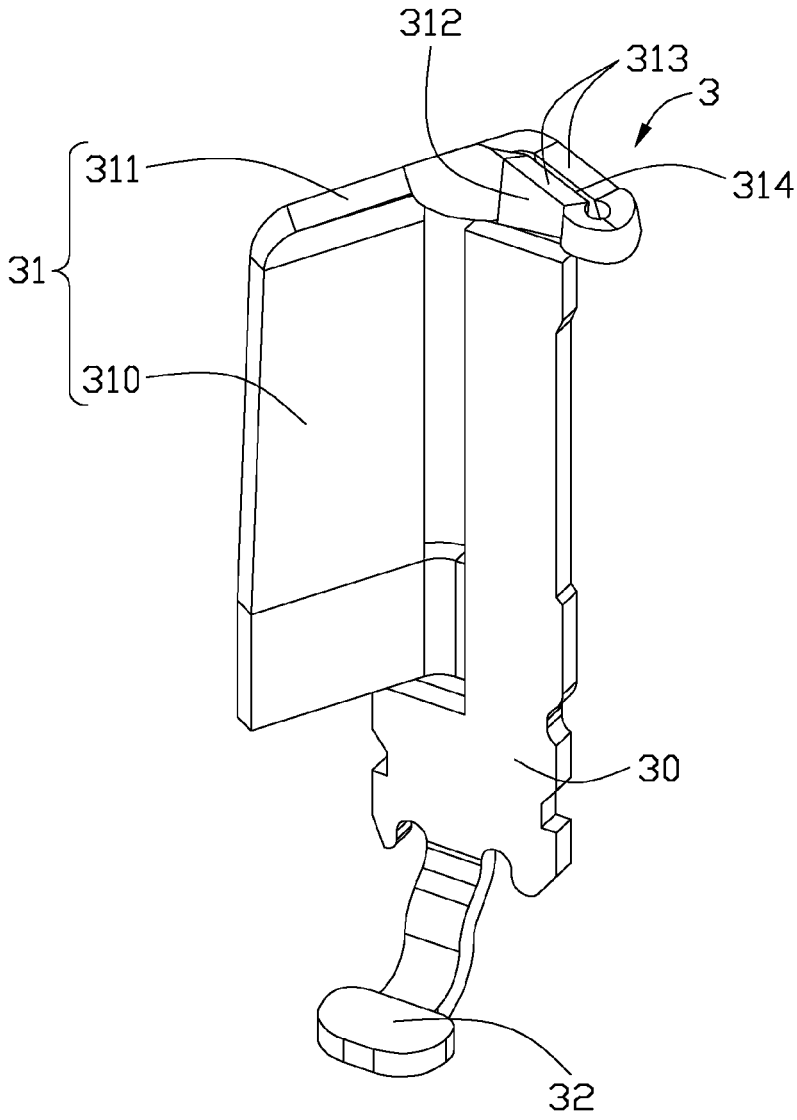
FIG. 3 is a perspective view of a contact of the socket connector as shown in FIG. 1.
Figure 4:
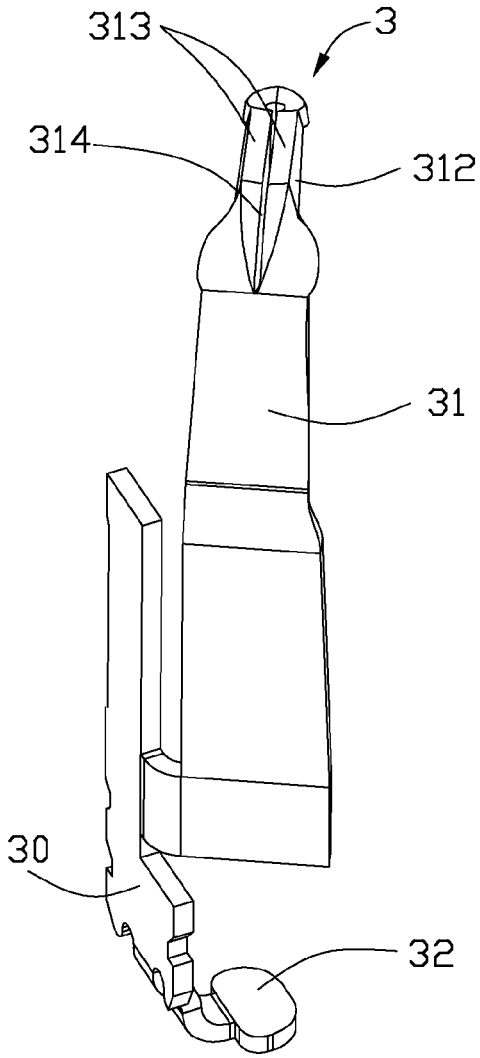
FIG. 4 is a perspective view of the contact as shown in FIG. 3 taken from a second view.
Figure 5:
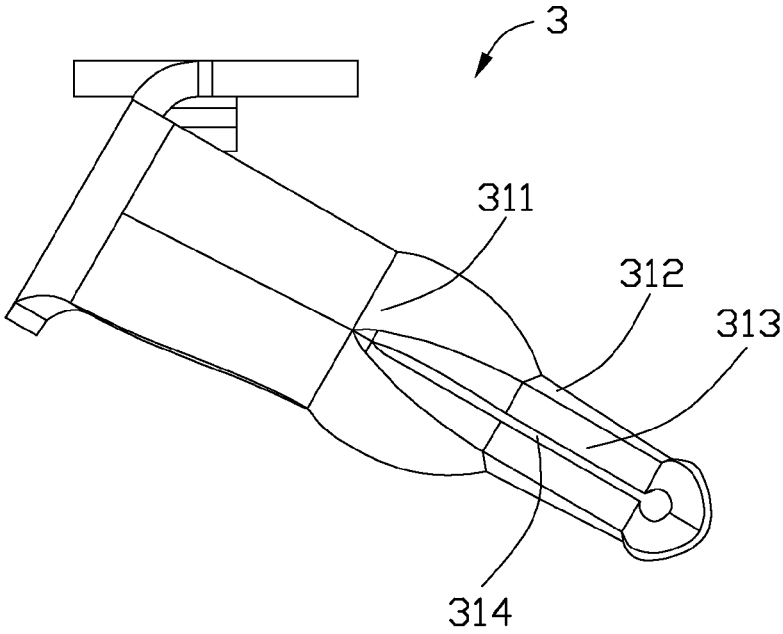
FIG. 5 is a perspective view of the contact as shown in FIG. 3 taken from a third view.
Figure 6:
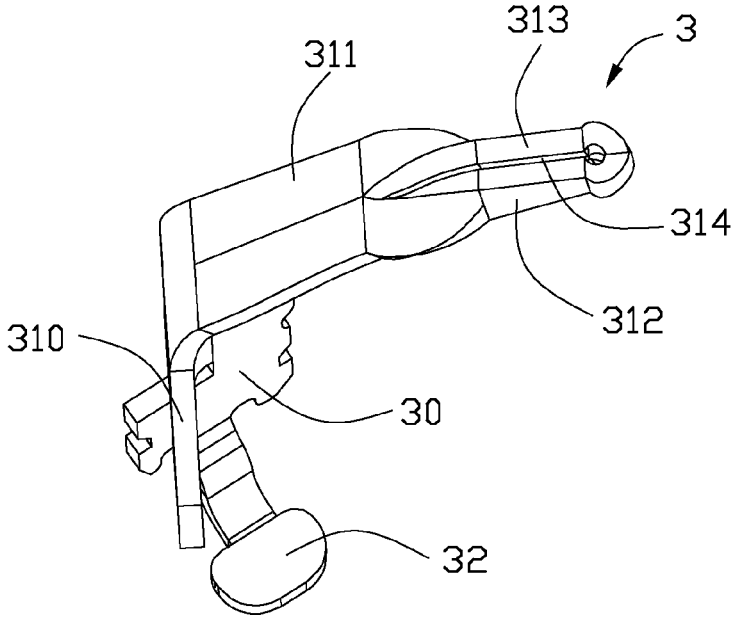
FIG. 6 is a perspective view of the contact as shown in FIG. 3 taken from a forth view.
Figure 7:
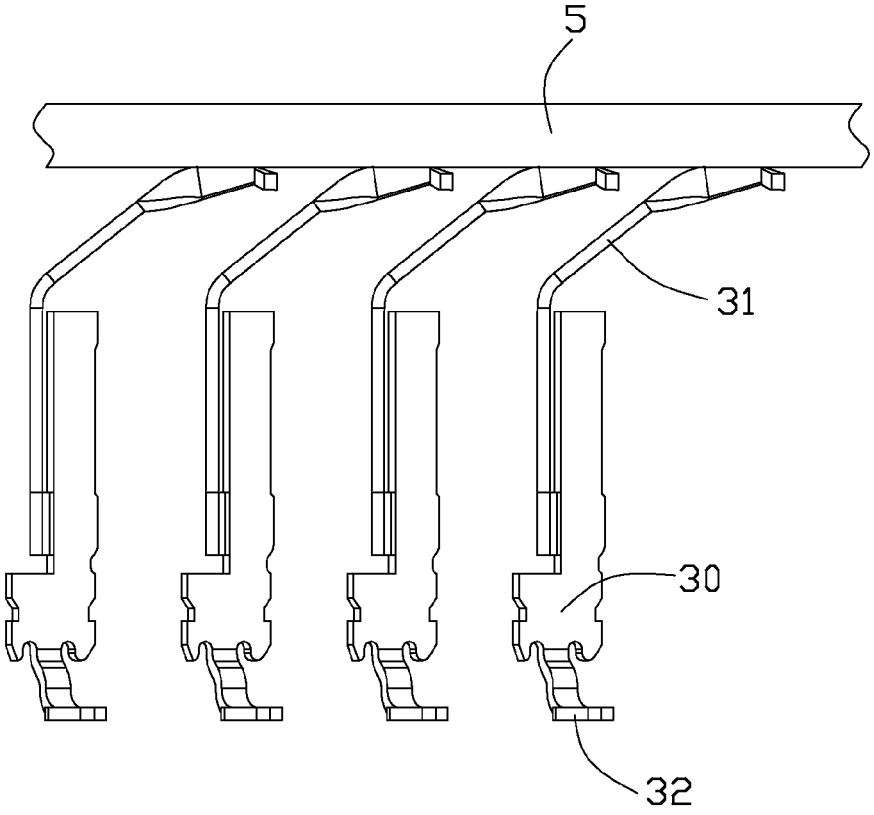
FIG. 7 is a side view illustrating the engagement between an LGA package and the contact as shown in FIG. 3.

Referring to FIGS. 1-2, a socket connector 1 made in accordance with the present invention is shown. The socket connector 1 includes a socket body 2, an array of contacts 3 received in the socket body 2, and a cap 4 mounted upon the socket body 2 for protecting the contacts 3. It is noted that the cap 4 is removed when an IC package (not shown) is mounted onto the socket body 2. The socket body 2 is formed with an array of passageways 20 and the contacts 3 are received in the passageways 20 respectively.

Particularly referring to FIGS. 3-7, the contact 3 is formed in an LGA manner which is adapted to engage with an LGA package 5. The contact 3 includes a retaining section 30 securely retained within the passageway 20 of the socket body 2, an engaging section 31 upwardly extending from the retaining section 30 and out of the passageway 20, and a soldering section 32 extending downwardly from the retaining section 30 and offsetting from the retaining section 30 from a top view. The engaging section 31 further includes a resilient arm 311 extending obliquely and upwardly, and an upstanding arm 310 for lifting the resilient arm 311. The resilient arm 311 is formed with a board shape and defines a primary surface 312.

The resilient arm 311 is partially split at a top and end position thereof along its extending direction, and a gap 314 is thus formed to divides the end part of the resilient arm 311 into two sections (not labeled) each generating a split surface 313 perpendicular to the primary surface 312. Each section is then distorted to displace the split surface 313 exposed upwardly, and the primary surface 312 is simultaneously rotated to be laterally exposed. The free ends of the split surfaces 313 are interconnected with each other and the gap 314 is enclosed. The split surfaces 313 perform as contacting surfaces for engaging with the LGA package 5.

The total width of the split surfaces 313 is configured to be smaller than that of corresponding primary surface 312. As it is well known in the field of the invention that narrower contacting area is likely to result lower LLCR under a condition that the transmittal path, i.e. the cross sectional area thereof is not changed. Based on this, lower and better LLCR could be acquired by using split surfaces as contacting surfaces in stead of the primary surface, and in this condition, a resilient arm that has a shorter length will suffice. Moreover, lower profile socket connector is obtained by using such shorter contacts.

Figure 8:
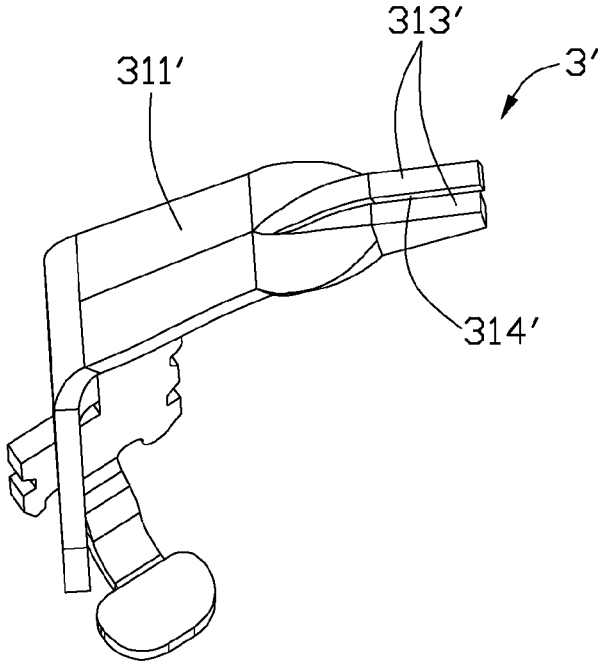
FIG. 8 is a perspective view of a contact made with a modification to the contact as shown in FIG. 3.

Referring to FIG. 8, a modification is made to the preferred embodiment. A contact 3' is provided with a similar structure with the contact 3 shown in FIGS. 3-7, except that a resilient arm 311' of the contact 3' is split and distorted to produce a pair of upwardly exposed split surfaces 313' with free ends thereof discrete with each other. The gap 314' between the two split surfaces 313' is therefore opened. This modification does not result essential affection to the function of the contact 3'.

While preferred embodiments in accordance with the present invention has been shown and described, equivalent modifications and changes known to persons skilled in the art according to the spirit of the present invention are considered within the scope of the present invention as defined in the appended claims.

What is claimed is:

1. A socket connector, comprising:

a socket body having an array of passageways;

an array of contacts received in passageways respectively, each contact comprising a retaining section received within the passageway, an engaging section extending from the retaining section, the engaging section having an oblique resilient arm extending out of the passageway;

wherein an upper end of the resilient arm is split and altered to form primary surfaces vertically facing to each other so that a pair of split surfaces are formed as contacting surfaces which are substantially exposed upwardly of the passageway;

wherein the pair of the split surfaces defines a gap therebetween;

wherein the pair of the split surfaces have ends interconnecting with each other such that the gap is enclosed; and wherein the engaging section further comprises an upstanding arm lifting the resilient arm.

2. The socket connector as claimed in claim 1, wherein the gap extends along the extending direction of the resilient arm.

3. A contact for use with an electrical pad of an LGA package, comprising:

a main body having an engaging section and an upward extending resilient contacting section for contacting said LGA, and a lower end for contacting to another electrical part;

said contacting section defining a slit along an extending direction of said contacting section to form two parts by two sides of the slit;

wherein said two parts are twisted opposite to each other with 90 degrees, and said two parts respectively define two corresponding split surfaces facing upwardly and being adapted for engagement with the corresponding pad under condition that said split surface is formed by material of the contacting section in a thickness direction of said contacting section;

wherein the two corresponding split surfaces are essentially intimately positioned with each other in a parallel relation with said slit therebetween;

wherein free ends of said two parts are joined together; and wherein the engaging section further comprises an upstanding arm lifting the resilient arm.

4. The contact as claimed in claim 3, wherein said slit extends within a range which is essentially in a peak portion of the contacting section in a side view.

5. The contact as claimed in claim 4, wherein the contacting section defines a gradually reduced width along the slit in the range.

6. The contact as claimed in claim 5, wherein the range is longer than one half of said resilient contacting section along said extending direction.

7. The contact as claimed in claim 5, wherein the split surface is dimensioned along said extending direction with proximal one half of a length of the slit.

* * * * *